US010368151B2

(12) United States Patent
Park et al.

(10) Patent No.: US 10,368,151 B2
(45) Date of Patent: Jul. 30, 2019

(54) EXTERIOR COVER WITH SPEAKER

(71) Applicant: Samsung Electronics Co., Ltd., Gyeonggi-do (KR)

(72) Inventors: Youngbae Park, Chungcheongbuk-do (KR); Byounghee Lee, Seoul (KR); Hochul Hwang, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 298 days.

(21) Appl. No.: 15/003,357

(22) Filed: Jan. 21, 2016

(65) Prior Publication Data

US 2016/0212516 A1 Jul. 21, 2016

(30) Foreign Application Priority Data

Jan. 21, 2015 (KR) ..... 10-2015-0010108

(51) Int. Cl.

| | |
|---|---|
| ***H04R 25/00*** | (2006.01) |
| ***H04R 1/02*** | (2006.01) |
| *H04R 7/10* | (2006.01) |
| *H04R 17/00* | (2006.01) |
| *H04R 23/00* | (2006.01) |

(52) U.S. Cl.

CPC ..... *H04R 1/028* (2013.01); *H04R 7/10* (2013.01); *H04R 17/00* (2013.01); *H04R 23/00* (2013.01)

(58) Field of Classification Search

CPC ..... H04R 1/028; H04R 7/10; H04R 17/00; H04R 23/00

USPC ..... 318/182

See application file for complete search history.

(56) References Cited

U.S. PATENT DOCUMENTS

| | | | | |
|---|---|---|---|---|
| 8,593,802 | B1 | 11/2013 | Strauser | |
| 9,584,891 | B1 * | 2/2017 | Blaszczak | H04R 1/028 |
| 2005/0129264 | A1 * | 6/2005 | Mitsuishi | G11B 5/5526 381/396 |
| 2007/0081681 | A1 * | 4/2007 | Yu | B06B 1/0688 381/190 |
| 2009/0214074 | A1 * | 8/2009 | Liao | H04R 1/028 381/386 |
| 2012/0275636 | A1 * | 11/2012 | Vissia | H04R 1/028 381/387 |
| 2013/0083953 | A1 | 4/2013 | Chang | |
| 2013/0108061 | A1 * | 5/2013 | Ando | G06F 3/0433 381/55 |
| 2013/0177181 | A1 * | 7/2013 | Marcus | H04R 1/02 381/189 |
| 2013/0230202 | A1 | 9/2013 | Widner et al. | |

(Continued)

FOREIGN PATENT DOCUMENTS

| | | | |
|---|---|---|---|
| JP | 2013102408 A | * | 5/2013 |
| KR | 1020100128617 | | 12/2010 |

*Primary Examiner* — Sean H Nguyen

(74) *Attorney, Agent, or Firm* — The Farrell Law Firm, P.C.

(57) ABSTRACT

The present disclosure provides an exterior cover of an electronic device including a cover that protects a display of the electronic device. The cover may include one or more speakers. The cover may be folded one or more times to support the electronic device to be inclined and the speaker may include any one of a film speaker, a vibration speaker, a piezoelectric speaker, and a thin micro speaker. In addition, the exterior cover may include a vibration plate that is arranged thereon and any electronic component may also be arranged on the exterior cover as long as the electronic component is slim.

12 Claims, 9 Drawing Sheets

(56) References Cited

U.S. PATENT DOCUMENTS

2014/0159867 A1 6/2014 Sartee et al.
2014/0291176 A1* 10/2014 Chung ..... G06F 1/1656
206/45.23

* cited by examiner

EXTERIOR COVER WITH SPEAKER

PRIORITY

This application claims priority under 35 U.S.C. § 119(a) to Korean Patent Application Serial No. 10-2015-0010108, which was filed in the Korean Intellectual Property Office on Jan. 21, 2015, the entire content of which is incorporated herein by reference.

BACKGROUND

1. Field of the Disclosure

The present disclosure generally relates to an exterior cover of an electronic device.

2. Description of the Related Art

In general, users mount an exterior cover on an electronic device (e.g., a smart phone or a tablet PC), which is carried by the user, in order to physically protect the electronic device. The exterior cover is typically detachably provided to the electronic device so as to protect the front face, the sides and/or the rear face of the electronic device. Since the electronic device is frequently carried, shock may be generated due to dropping the device, and the outer surface may be frequently damaged by an outer surface scratch and the like. Thus, the electronic device is protected by the exterior cover.

The exterior cover may also provide a feeling of exclusivity by including a skin that is made of, for example, different colored leather.

An electronic device, such as a smart phone or a tablet PC, includes a display and/or a touch screen that are placed on the front face thereof. Thus, the front face is protected by the exterior cover.

A common exterior cover includes an upper cover and a lower cover (or a front and back cover), with the upper and lower covers integrally connected to each other by a connecting portion. The upper cover is folded or unfolded on the front face, which is a display screen of the electronic device.

While using the electronic device, it is sometimes inconvenient to type or to watch a display screen. For example, when the electronic device is used in an input-centered mode where data is input using a stylus pen or when a virtual keyboard is used, the user may conveniently perform a typing input operation when the electronic device is maintained in a slightly inclined state (e.g., the state where the electronic device is cradled to be inclined at an angle of about 15 degrees).

In a display-centered mode where the user watches a display screen of the electronic device, the user may conveniently watch the display screen when the electronic device is maintained in a greatly inclined state (e.g., the state where the electronic device is cradled to be inclined at an angle of about 70 degrees). In addition, in order for the user to carry the electronic device, the front face of the electronic device, on which the display is disposed, should be protected from the external environment when carrying the electronic device.

It is convenient to type on the electronic device when the electronic device is in the slightly inclined state, and it is convenient to watch a display screen on the electronic device when the electronic device is in the greatly inclined state. In order to provide such convenience, a separate portable cradle for an electronic device is provided or a cradle is provided on an exterior cover that is provided on an electronic device.

SUMMARY

The present disclosure has been made to address at least the problems and disadvantages described above and to provide at least the advantages described below.

An aspect of the present disclosure is to apply one or more film speakers to an exterior cover that is adopted as an accessory of, for example, a tablet PC, among electronic devices.

Another aspect of the present disclosure is to apply one or more vibration speakers to an exterior cover that is adopted as an accessory of, for example, a tablet PC, among electronic devices.

Another aspect of the present disclosure is to apply one or more micro speakers to an exterior cover that is adopted as an accessory of, for example, a tablet PC, among electronic devices.

Another aspect of the present disclosure is to apply one or more piezoelectric speakers to an exterior cover that is adopted as an accessory of, for example, a tablet PC, among electronic devices.

Another aspect of the present disclosure is to provide an exterior cover in which a speaker serves as a cradle.

Another aspect of the present disclosure is to provide an exterior cover that may be suited for a desired sound performance while using the merits of a thin and transparent film speaker as much as possible.

Another aspect of the present disclosure is to provide an exterior cover that may support the sound volume of a tablet PC itself, may protect a liquid crystal of the tablet PC, and may allow displayed information of the tablet PC to be seen, even if the exterior cover is closed Another aspect of the present disclosure is to provide an exterior cover in which a vibration plate may be mounted on a surface of the exterior cover, which comes in contact with a floor, in order to secure an insufficient low band of a speaker.

Another aspect of the present disclosure provides an exterior cover of an electronic device, which includes a cover that protects a display of the electronic device. The cover may include one or more speakers. The cover may be folded one or more times to support the electronic device to be inclined. The speaker may include any one of a film speaker, a vibration speaker, a piezoelectric speaker, and a thin micro speaker.

Another aspect of the present disclosure provides an exterior cover that may include a display of the electronic device, and at least one thin electronic component that has an area to cover the display and is connected to the display.

BRIEF DESCRIPTION OF THE DRAWINGS

The above and other aspects, features, and advantages of the present disclosure will become more apparent from the following detailed description when taken in conjunction with the accompanying drawings, in which.

DETAILED DESCRIPTION

Figure 1:
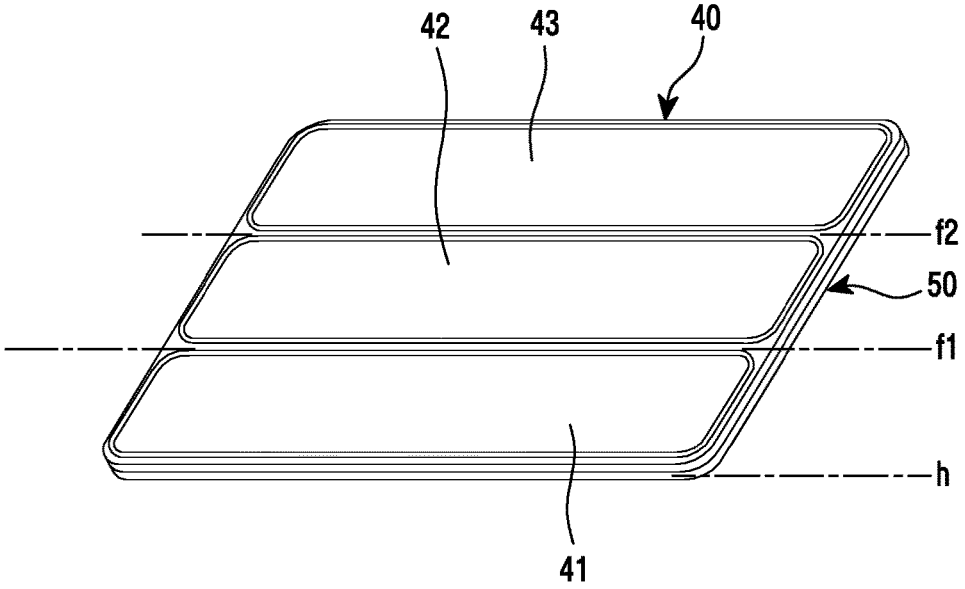
FIG. 1 is a perspective view illustrating speakers that are adapted to an exterior cover according to an embodiment of the present disclosure in which the exterior cover protects an electronic device.

Hereinafter, embodiments of the present disclosure will be explained with reference to the accompanying drawings. Although embodiments of the present disclosure are illustrated in the drawings and relevant detailed descriptions are provided, various changes can be made and other embodiments may be provided. Accordingly, embodiments of the present disclosure are not limited to the specific embodiments and should be construed as including all changes and/or equivalents or substitutes included in the ideas and technical scope of embodiments of the present disclosure. In the explanation of the drawings, similar reference numerals are used for similar elements.

The terms "include" or "may include" used in describing the embodiments of the present disclosure indicate the presence of disclosed corresponding functions, operations, elements, and the like, and do not limit additional functions, operations, elements, and the like. In addition, it should be understood that the terms "include" or "have" used in describing the embodiments of the present disclosure are to indicate the presence of features, numbers, steps, operations, elements, parts, or a combination thereof described in the specification, and do not preclude the presence or addition of one or more other features, numbers, steps, operations, elements, parts, or a combination thereof.

The term "or" used in the embodiments of the present disclosure include any and all combinations of words enumerated with it. For example, "A or B" means including A, including B, or including both A and B.

Although the terms such as "first" and "second" used in the embodiments of the present disclosure may modify various elements of the embodiments, these terms do not limit the corresponding elements. For example, these terms do not limit an order and/or importance of the corresponding elements. These terms may be used for the purpose of distinguishing one element from another element. For example, a first electronic device and a second electronic device all indicate electronic devices and may indicate different electronic devices. For example, a first element may be referred to as a second element without departing from the scope of the embodiments of the present invention and similarly, a second element may be referred to as a first element.

It will be understood that when an element is mentioned as being "connected" or "coupled" to another element, the element may be directly connected or coupled to another element and there may be an intervening element between the element and another element. To the contrary, it will be understood that when an element is mentioned as being "directly connected" or "directly coupled" to another element, there is no intervening element between the element and another element.

The terms used in the embodiments of the present disclosure are for the purpose of describing specific embodiments only and are not intended to limit embodiments of the present disclosure. As used herein, the singular forms are intended to include the plural forms as well, unless the context clearly indicates otherwise. All of the terms used herein including technical or scientific terms have the same meanings as those generally understood by a person of ordinary skill in the related art unless they are defined otherwise. The terms defined in a generally used dictionary should be interpreted as having the same meanings as the contextual meanings of the relevant technology and should not be interpreted as having ideal or exaggerated meanings unless they are clearly defined in the embodiments.

An electronic device according to embodiments of the present disclosure may be a device that is equipped with a communication function. For example, the electronic device may include at least one of a smartphone, a tablet personal computer (PC), a mobile phone, a video phone, an electronic book reader, a desktop PC, a laptop PC, a netbook computer, a Personal Digital Assistant (PDA), a Portable Multimedia Player (PMP), an MP3 player, a mobile medical machine, a camera, or a wearable device (for example, a head-mounted-device (HMD) such as electronic glasses, electronic clothing, an electronic bracelet, an electronic necklace, an electronic appcessory, electronic tattoos, or a smart watch).

The electronic device according to embodiments of the present disclosure may be one or a combination of one or more of the above-mentioned devices. In addition, the electronic device according to embodiments of the present disclosure may be a flexible device. In addition, it is obvious to person of ordinary skill in the related art that the electronic device according to embodiments of the present disclosure is not limited to the above-mentioned devices.

Hereinafter, an electronic device according to embodiments will be explained with reference to the accompanying drawings. The term "user" used in the embodiments may refer to a person who uses the electronic device or a device that uses the electronic device (for example, an artificial intelligence electronic device).

Hereinafter, descriptions will be made on a configuration of an exterior cover according to an embodiment of the present disclosure with reference to the accompanying drawings. For example, descriptions will be made on an exterior cover that is adapted as an accessory to an electronic device, such as a tablet PC.

Figure 2:
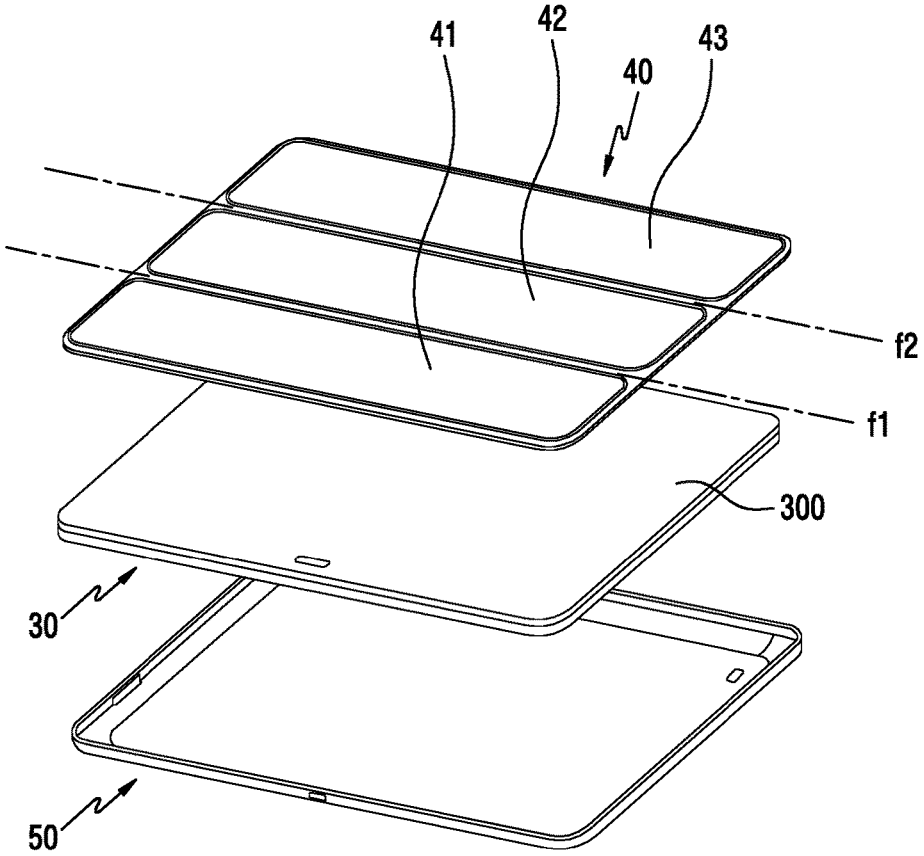
FIG. 2 is an exploded perspective view illustrating the exterior cover that is adapted to an electronic device according to an embodiment of the present disclosure in which the exterior cover is separated from a bottom cover.

FIG. 1 is a perspective view illustrating speakers that are adapted to an exterior cover according to an embodiment of the present disclosure in which the exterior cover protects an electronic device. FIG. 2 is an exploded perspective view illustrating the exterior cover that is adapted to an electronic device according to an embodiment of the present disclosure in which the exterior cover is separated from a bottom cover for the convenience of description.

As illustrated in FIGS. 1 and 2, according to an embodiment of the present disclosure, an exterior cover refers to a cover that is provided to an electronic device 30 to be carried together with the electronic device 30. In particular, the exterior cover may protect the exterior of the electronic device 30 and may support the electronic device when inclined. The exterior cover may enrich sound volume even in a low frequency sound band by being adapted such that speakers are provided on the front face thereof. The exterior cover may also serve as a transparent window and may perform a touch function.

According to an embodiment of the present disclosure, the exterior cover 40 may include a sound component that is associated with sound (e.g., a component, such as a speaker) and has a film-like thickness (film shape). One or more speakers may be provided on a portion or the entire exterior cover. The speakers may include any one of a film speaker, a vibration speaker, a piezoelectric speaker, and a micro speaker that is thin. Any sound component may be mounted on the exterior cover without limitation so long as the sound component is thin.

The speakers may include a thin speaker that has an ordinary film thickness and may include one or more vibration plates in order to emit different frequency bands of sound.

The exterior cover may apply film speakers of various types. The number of speakers that are applied to the exterior cover 40, or the application type of the speakers, is not limited. For example, three speakers may be applied to the exterior cover 40, or two speakers and one vibration plate may be applied to the exterior cover 40. The following description merely provides examples of exterior covers according to an embodiment of the present disclosure. Thus, a detailed structure may depart from the following embodiments and the scope of the present disclosure is determined only by the claims and their equivalents.

The electronic device 30 refers to a portable slim electronic device among ordinary electronic products and in particular, may refer to a miniaturized and slim mobile communication device. The electronic device 30 may be a mobile phone, a palm sized personal computer (PC), a Personal Communication System (PCS), a Personal Digital Assistant (PDA), a Hand-held PC (HPC), a smart phone, a wireless Local Area Network (LAN) terminal, a laptop computer, a netbook PC, a notebook PC, and a tablet PC.

In an embodiment of the present disclosure, the electronic device 30 may be a tablet PC or a smart phone. Hereinafter, descriptions will be made on a configuration of an exterior cover according to an embodiment of the present disclosure, assuming that the electronic device 30 is a tablet PC.

The electronic device 30 may include a display or a touch screen that enables a touch input and is placed on the front face 300 thereof, and is protected by an exterior cover. In addition, when the electronic device 30 includes a touch screen that is placed on the front face 300 thereof, the electronic device 30 may process an input that is made by a touch of a finger, a stylus pen, and the like.

According to an embodiment of the present disclosure, the exterior cover refers to a cover that performs a protection function, a cradling function, and a speaker function and may include a first cover 50 and a second cover 40. The first cover 50 may or may not be included in the exterior cover. In addition, according to an embodiment of the present disclosure, the second cover 40 may be adapted as a front cover of the tablet PC and may thus be referred to as a tablet cover. The second cover 40 may protect a display that is adapted to the tablet PC, and may thus be referred to as a display cover.

The second cover 40 may be electrically and mechanically connected to the electronic device and the first cover 50 may be coupled to or separated from the second cover 40. The first cover 50 may be positioned on the rear face of the electronic device and may be referred to as a rear cover. The second cover 40 may be positioned on the front face of the electronic device and may be referred to as a front cover. The first and second covers 50 and 40 may be configured to be separated from each other or to be integrated with each other. In addition, the first cover 50 may be configured to be provided on the electronic device 30. The first cover and/or the second cover may be made of a rigid material or a flexible material. The first cover 50 may be made of a synthetic resin. The second cover 40 may be made of a flexible material (e.g., leather or a material that provides a leather-like feeling). In addition, the second cover 40 may only be constructed with one or more speakers.

In addition, the first and second covers 50 and 40 may include a region that encloses the rear face of the electronic device and a region that encloses the front face of the electronic device, respectively, when one of the covers is folded. In addition, the first and second covers 50 and 40 may be integrally connected to each other or may be configured to be separated from each other and to be connected to each other by a flexible material, a hinge, and the like. The connecting portion between the first and second covers 50 and 40 may be made of a flexible material so as to provide a folding axis. FIG. 2 illustrates the first and second covers 50 and 40 in the separated state.

In addition, the first cover 50 may be configured in a base structure type such that the electronic device 30 is detachable from the first cover 50. The electronic device 30 may be separated from or attached to the first cover 50, and may be coupled to the first cover 50 using a fastener. The second cover 40 is foldably connected to the first cover 50 by a main folding line h, and may be arranged to be folded to or unfolded from the front face 300 (display unit) of the electronic device 30. The first cover 50 and the second cover 40 may have sizes that provide an area to cover the rear face and the front face of the electronic device 30, respectively.

The second cover 40 may include at least one speaker that has an area to cover the front face 300 of the electronic device, more specifically the display. The speaker includes one or more film speakers 41 to 43. The one or more film speakers 41 to 43 are configured to have an area to cover at least a portion or the entire of the front face of the electronic device (e.g., the display). The one or more film speakers 41 to 43 may include at least one vibration plate. The second cover 40 may be folded one or more times to support the electronic device 30 to be inclined in various cradling modes.

The second cover 40 may be divided into a plurality of regions, in which a speaker or a vibration plate may be mounted on each of the divided regions. When the second cover 40 is divided into three regions, the second cover 40 may be configured with three speakers mounted thereon, such that two speakers and one vibration plate may be mounted thereon, or one speaker and two vibration plates may be mounted thereon.

In addition, the second cover 40 may be divided into a plurality of regions. When the speakers are configured as film speakers, a film speaker or a vibration plate may be mounted on each of the divided regions. When the second cover 40 is divided into three regions, the second cover 40 may be configured with three film speakers may be mounted thereon such that, two film speakers and one vibration plate may be mounted thereon, or one speaker and two vibration plates may be mounted thereon. In addition, the second cover 40 may also be constructed with three vibration plates.

In addition, each of the film speakers may be replaced by speakers that are thin, such as a vibration speaker, a piezoelectric speaker or a thin micro speaker. Hereinafter, descriptions will be made assuming that first to third film speakers 41 to 43 are mounted on the second cover 40. The second cover 40 includes first and second folding axes f1 and f2 that are parallel to the direction of the main folding axis h and may include first to third film speakers 41 to 43 that are separated from each other by the first and second folding lines 11 and f2. That is, the first to third speakers 41 to 43 may be folded along the first and second folding axes f1 and f2, respectively. The first film speaker 41 may be folded about the main folding axis h. Each of the first to third speakers 41 to 43 may be made of a rigid material in a rectangular plate shape having a substantially thin thickness. The first to third film speakers 41 to 43 may be configured to have substantially the same areas or may be configured to have substantially different areas. In order to enable the cradling angles of various cradling modes of the electronic device to be changed, the first to third film speakers 41 to 43 may be configured to have different areas. Thin portions may be interposed between the first to third film speakers 41 to 43 that are mounted on the second cover 40 such that the thin portions may be the first and second folding axes f1 and f2. The first and second folding axis f1 and 12 may include a flexible material.

In addition, since the first to third film speakers 41 to 43 are made of a rigid material, each of the film speakers may also serve to support the electronic device 30 to be inclined. Accordingly, the first to third speakers 41 to 43 may serve as first to third support stands. However, each of the first to third film speakers may be made of a flexible material. A configuration will be described in reference to FIGS. 3 and 4 below in which the first to third film speakers 41 to 43 serve as supports. Although not illustrated in the drawings, the exterior cover may include one or more magnetic bodies such that the electronic device, which is cradled to be inclined, can be supported in a stable fashion.

According to an embodiment of the present disclosure, the exterior cover may reproduce a larger sound pressure since three thin speakers and the speaker of the tablet PC itself perform sound reproduction simultaneously. In addition, when the tablet PC reproduces music or a movie, the speaker of the tablet PC itself performs sound reproduction, and at the same time, the plurality of speakers of the exterior cover perform sound reproduction so that sound can be heard at a higher volume.

In the case of the speaker of the tablet PC itself, there may be a degradation in high frequency band performance or in a specific frequency band performance due to structural reasons (during sound emission, high frequency band performance may be degraded due to obstructions in the sound wave path.). According to an embodiment of the present disclosure, the thin speakers are tuned to complement the insufficient bandwidth of the tablet PC such that a better performance can be exhibited when sound reproduction is performed together with the speakers.

Accordingly, when three thin speakers are mounted on the exterior cover, different inputs may be applied to the speakers such that the speakers may perform sound reproduction in different frequency bands. Thus, a better sound performance can be exhibited. In addition, for the reproduction of different frequency bands, a sound component besides the speakers may be added without limitation.

Hereinafter, descriptions will be made on a configuration that supports the electronic device at various inclined angles using the exterior cover according to an embodiment of the present disclosure, i.e. one or more film speakers and a vibration plate and operation of the speakers in the cradled state.

Figure 3:
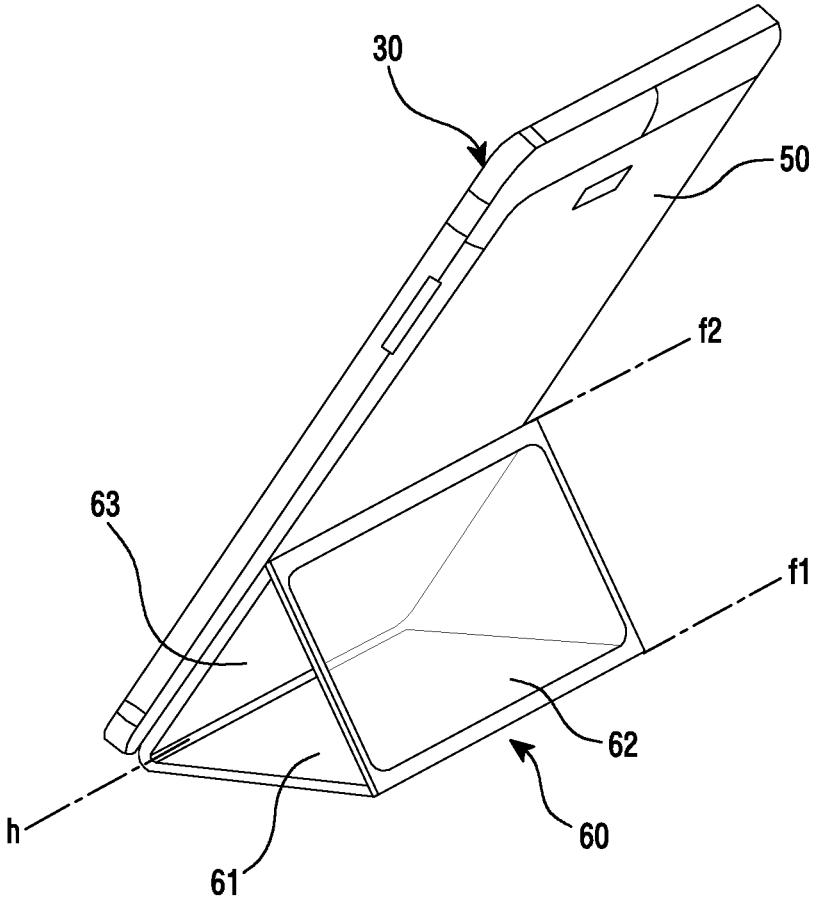
FIG. 3 is a perspective view illustrating the exterior cover that is adapted to an electronic device according to an embodiment of the present disclosure in which the exterior cover supports the electronic device in a first cradling mode.

FIG. 3 is a perspective view illustrating the exterior cover that is adapted to an electronic device according to an embodiment of the present disclosure in which the exterior cover supports the electronic device in a first cradling mode. The first mode may include a stand mode. The stand mode refers to a state in which the electronic device is cradled to be inclined such that the user can conveniently watch the display of the electronic device.

FIG. 3 illustrates a cradling mode that indicates the stand mode of an electronic device, such as a tablet PC, among various cradle modes. Using the exterior cover, the electronic device may be supported to be inclined at an angle of about 60 to 70 degrees. According to an embodiment of the present disclosure, an exterior cover 60 may include first and second speakers 62 and 63 and a vibration plate 61. The vibration plate 61 may be connected to be folded about the main folding axis and the first and second speakers 62 and 63 may be connected to the vibration plate 61. The first speaker 62 may be directly connected to the vibration plate 61. A main folding axis h may be positioned between the first cover 50 and the vibration plate 61, a first folding axis f1 may be positioned between the vibration plate 61 and the first speaker 62, and a second folding axis f2 may be positioned between the first and second speakers 62 and 63. The first main folding axis h and the first and second folding axes f1 and f2 may be spaced apart from each other and may be arranged parallel to each other.

According to an embodiment of the present disclosure, the first and second speakers 62 and 63 and vibration plate 61 are mounted on the exterior cover 60 such that one surface, which is in contact with the surface on the electronic device is placed, causes sound to echo from the surface, while the vibration plate 61 reproduces sound at a low frequency band, and the speakers 62 and 63, which have a high frequency band response, may reproduce sound at a high frequency band. The first and second speakers 62 and 63, which have better middle and high frequency band performance as compared to a low frequency band performance, are adapted to reproduce sound at the middle and high frequency band areas, and the vibration plate 61 is adapted to reproduce sound at the low frequency band when in contact with the surface on which the electronic device is placed.

In the stand mode, the vibration plate 61 and the first and second speakers 62 and 63 are folded at the main folding axis h and the first and second folding axes f1 and 12 such that the exterior cover 60 supports the electronic device 30 to be inclined. The vibration plate 61 is arranged to be in contact with the surface on the electronic device is placed to serve as an abutment, the first and second speakers 62 and 63 are arranged in the inclined state to face each other. The second speaker 63 may maintain the state in which the second speaker 63 is in close contact with the bottom surface of the first cover 50. In the stand mode as described above, the first and second speakers 62 and 63 may emit high frequency band sound, and the vibration plate 61 may be vibrated so as to vibrate low frequency band sound emitted from the first and second speakers such that the vibration plate 61 can support the low frequency band sound to enrich the sound volume.

According to an embodiment of the present disclosure, the exterior cover is in contact with the surface on the electronic device is placed at different portions depending on the position and angle of cradling the tablet PC, and thus, the position of the vibration plate is varied. However, the number and position of the vibration plates and the speakers is not limited. For example, two vibration plates and one speaker may be utilized.

Figure 4:
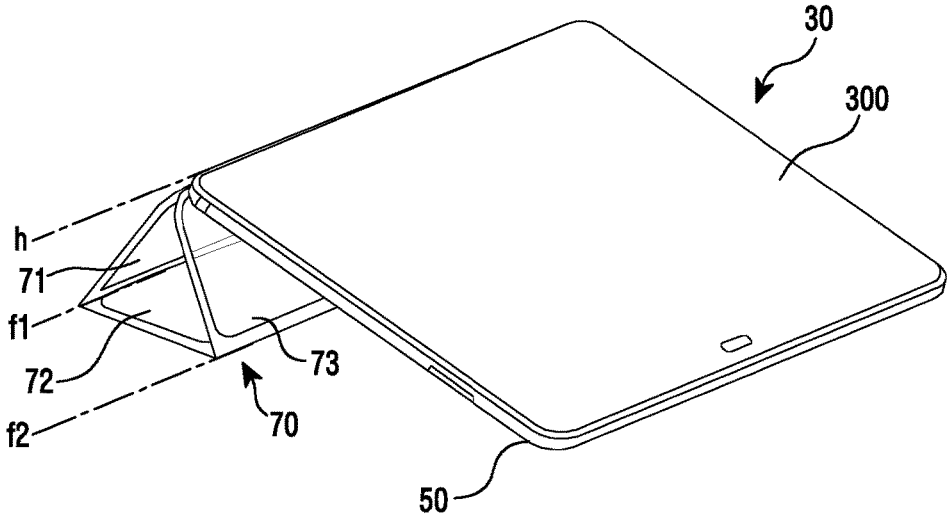
FIG. 4 is a perspective view illustrating the exterior cover that is adapted to an electronic device according to an embodiment of the present disclosure in which the exterior cover supports the electronic device in a second cradling mode.

FIG. 4 is a perspective view illustrating the exterior cover that is adapted to an electronic device according to an embodiment of the present disclosure in which the exterior cover supports the electronic device in a second cradling mode.

FIG. 4 illustrates a cradling mode that indicates a typing mode of an electronic device of a tablet PC type. Referring to FIG. 4, the electronic device 30 may be supported at an angle of about 15 degrees by the exterior cover 70. The typing mode refers to a mode in which a keyboard is displayed on a display screen 300 such that the user may conveniently perform typing by placing the user's hands on the keyboard.

According to an embodiment of the present disclosure, the exterior cover 70 may include first and second speakers 71 and 73 and a vibration plate 72 that is interposed between the first and second speakers 71 and 73. The first speaker 71 may be connected to the first cover 50 and each of the first and second speakers 71 and 73 may be directly connected to the vibration plate 72. A main folding axis h is positioned between the first cover 50 and the first speaker 71, a first folding axis f1 is positioned between the vibration plate 72 and the first speaker 71, and a second folding axis 12 is positioned between the vibration plate 72 and the second speaker 73. The main folding axis h and the first and second folding axes f1 and f2 are spaced apart from each other and are parallel to each other.

In the typing mode, the exterior cover 70 supports the electronic device 30 to be inclined by the vibration plate 72 and the first and second speakers 71 and 73. The vibration plate 72 is arranged to be in contact with the surface on the electronic device is placed, and the first and second speakers 71 and 73 are arranged in the inclined state to face each other. The electronic device is cradled to be inclined by the vibration plate 72 and the first and second speakers 71 and 73. In the cradling mode as described above, the first and second speakers 71 and 73 may emit high frequency band sound and the vibration plate 72 may be vibrated so as to vibrate low frequency band sound emitted from the first and second speakers 71 and 73 such that the vibration plate 72 can support the low frequency band sound of high volume. In other words, according to an embodiment of the present disclosure, two speakers (i.e., the first and second speakers 71 and 73) and one vibration plate 72 are mounted on the exterior cover 70 such that one surface, which is in contact with the surface on which the electronic device is placed, may reproduce sound at a low frequency band by causing sound to echo from the surface on which the electronic device is placed with the vibration plate 72, and the first and second speakers 71 and 73, which have a high frequency band response, may reproduce sound at a high frequency band. The first and second speakers 71 and 73, which are better in middle and high frequency band performances as compared to low frequency band performance, are adapted to reproduce sound at the middle and high frequency band areas, and the vibration plate 61 is adapted to reproduce sound at the low frequency band when in contact with the surface on which the electronic device is placed.

Figure 5:
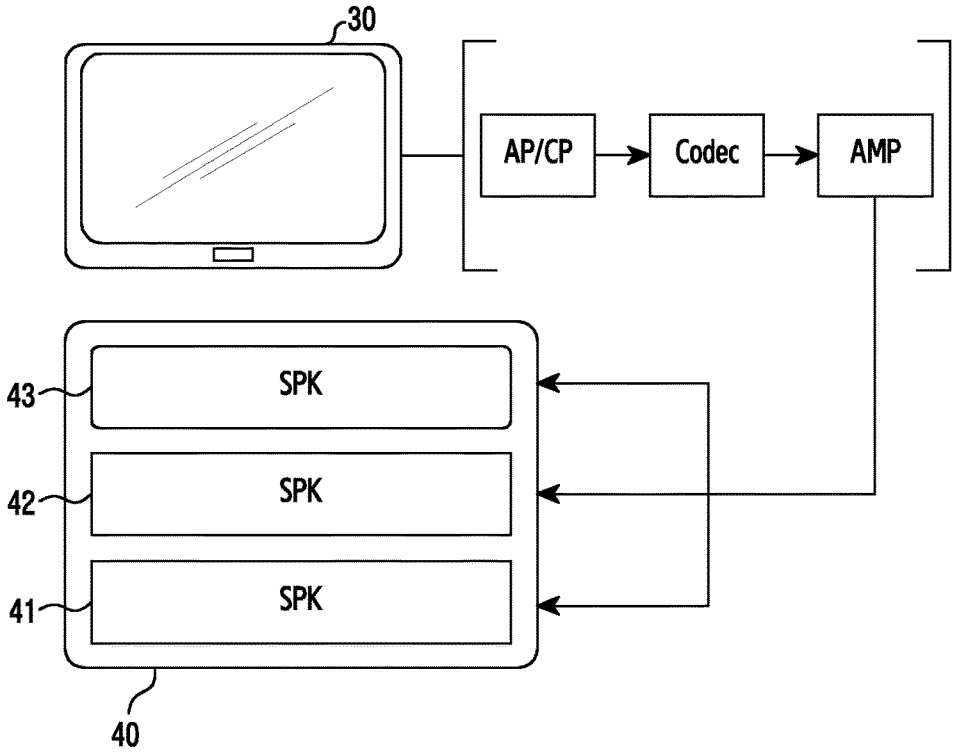
FIGS. 5 to 7 are diagrams illustrating operation of speakers that are mounted on an exterior cover according to an embodiment of the present disclosure.
Figure 6:
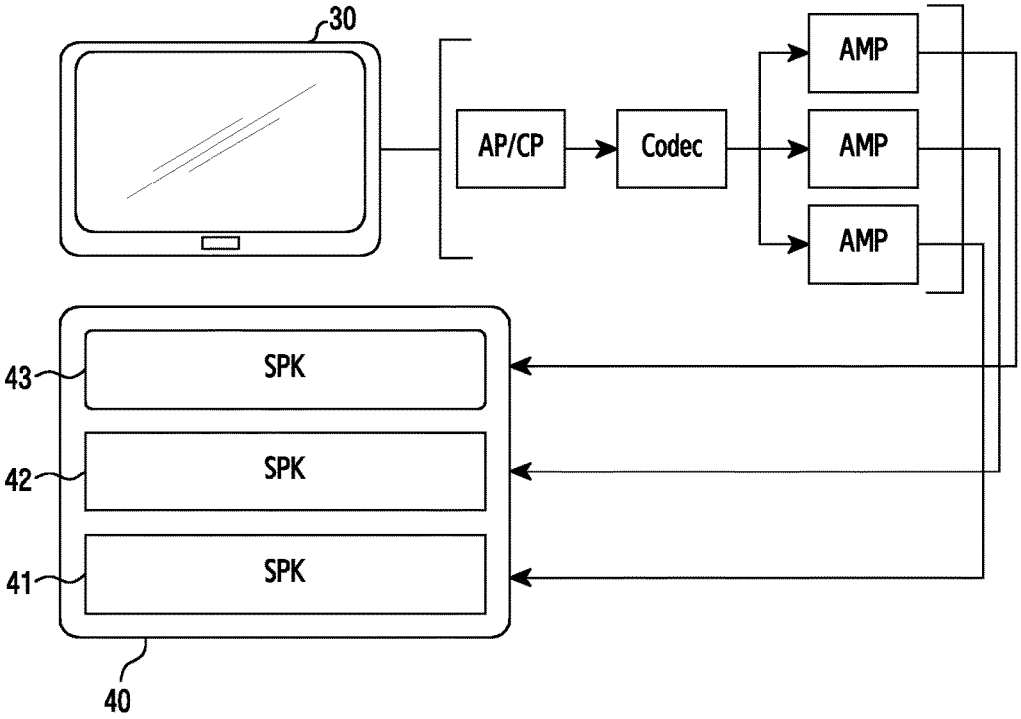
Figure 7:
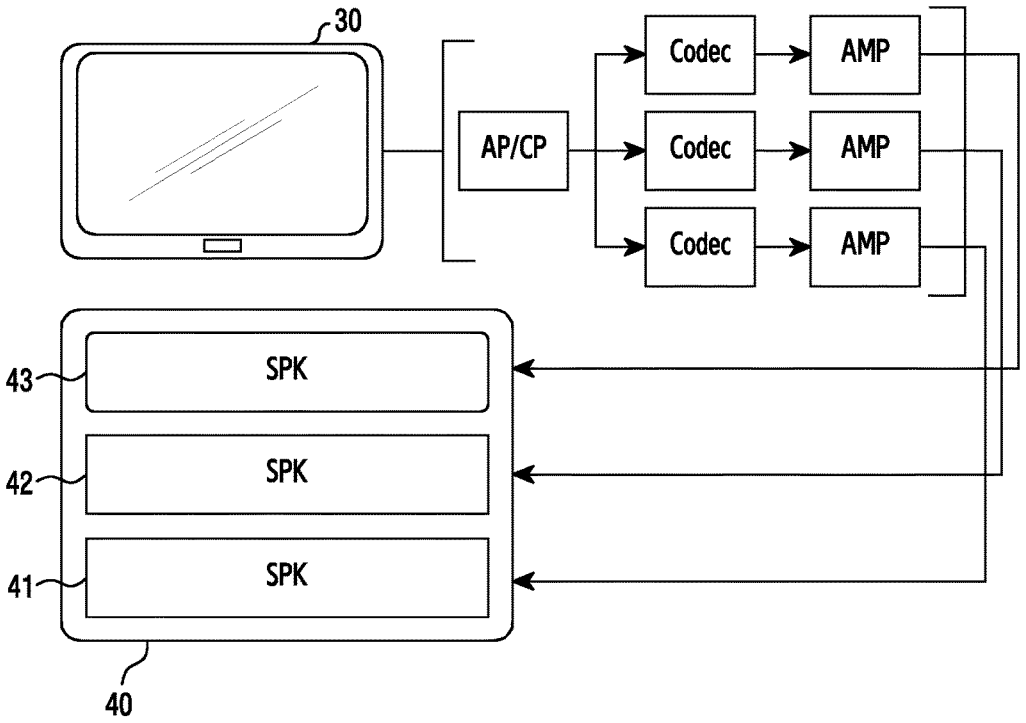

FIGS. 5 to 7 are views exemplifying operations of speakers that are mounted on an exterior cover according to an embodiment of the present disclosure, respectively.

Referring to FIGS. 5 to 7, according to an embodiment of the present disclosure, the first to third speakers, which are mounted on the exterior cover, may be configured to reproduce the same sound frequency band or to reproduce different sound frequency bands.

FIG. 5 illustrates a case in which a signal is simultaneously applied to the first to third speakers 41 to 43, which are mounted on the cover 40, from an amplifier of the electronic device 30. In such a case, the first to third speakers 41 to 43 may simultaneously emit the same frequency sound band. According to an embodiment of the present disclosure, the exterior cover may reproduce a larger sound pressure since three speakers and the speaker of the tablet PC itself perform sound reproduction simultaneously. In addition, when the tablet PC reproduces music or a movie, the speaker of the tablet PC itself performs sound reproduction and at the same time, the plurality of speakers of the exterior cover perform sound reproduction so that sound can be heard at a higher volume.

FIG. 6 illustrates a case in which signals are simultaneously applied to the first to third speakers 41 to 43, which are mounted on the cover 40, from amplifiers of the electronic device 30. In such a case, the first to third speakers 41 to 43 may simultaneously emit different sound frequency bands.

FIG. 7 illustrates a case in which signals are simultaneously applied to the first to third speakers 41 to 43, which are mounted on the cover 40, from Codecs and amplifiers of the electronic device 30. In such a case, the first to third speakers 41 to 43 may simultaneously emit different sound frequency bands. In addition, the first to third speakers may be speakers with different frequency band response, and may emit different sound frequency bands.

Figure 8:
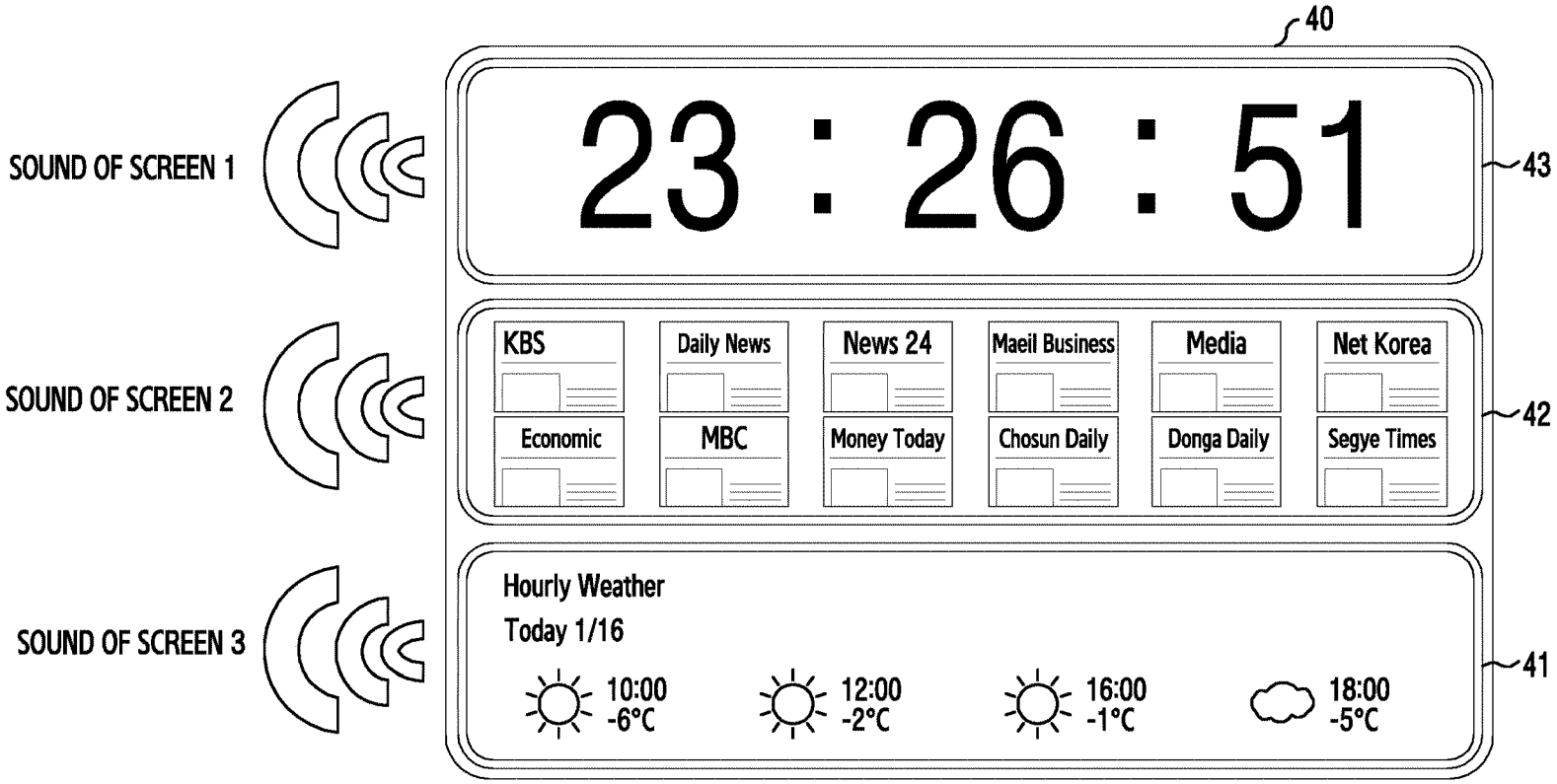
FIG. 8 is a diagram illustrating a state in which the exterior cover protects a display of the electronic device according to an embodiment of the present disclosure, in which film speakers emit sound to correspond to multiple screens, respectively.

Referring to FIG. 8, according to an embodiment of the present disclosure, at least one of the speakers, which are provided in the exterior cover 40, may be made of a transparent material, a translucent material or an opaque material. When each of the first to third speakers 41 to 43 is made of a transparent material, each of the first to third speakers 41 to 43 may serve as a transparent window. When the exterior cover 40 is folded on the electronic device, it is possible to watch the screen of the display, which is placed on the front face of the electronic device. This is enabled since the first to third speakers 41 to 43 are transparent.

When the exterior cover 40, which is equipped with the first to third speakers 41 to 43 is made of the transparent material different screens may also be watched on the speakers through which a display is seen, and different sounds which are associated with the screens, may be emitted through the speakers, respectively.

Figure 9:
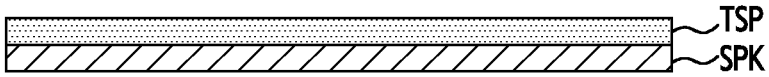
FIG. 9 is a cross-sectional view illustrating a state in which a touch input unit is mounted on a film speaker which is mounted on the exterior cover according to an embodiment of the present disclosure.

Referring to FIG. 9, a speaker SPK is provided with a touch input unit TSP such that an input may be made by a touch action. A Touch Sensitive Panel (TSP) made of a transparent material may be applied as the touch input unit TSP and may be mounted on the outer surface of the speaker SPK so as to provide a user interface environment which is different from that of the electronic device. In addition, a solar light panel of a transparent material may be mounted, instead of the touch input unit such that the solar light panel can supply power by to the electronic device.

In the case of a method of driving a speaker that is provided on the exterior cover, the contact terminal may be arranged on an outer periphery of the tablet PC and the contact terminal may be connected to an exterior case of the tablet PC. In addition, a contact terminal of the exterior case of the tablet PC and the speaker may be connected to each other using a Flexible Printed Circuit Board (FPCB). Besides the contact terminal, a signal may be applied to the speaker through universal serial bus (USB) connector or an earphone jack. Since the exterior cover has its own power, the exterior case of the tablet PC and the speaker may also be connected to each other through Bluetooth or WiFi. There is no limitation in methods of applying the signal.

According to an embodiment of the present disclosure, the number of speakers mounted on the exterior cover and the size of the exterior cover may be changed and various sound components, such as a vibration plate and a piezoelectric speaker, may be mounted instead of the thin speakers. In addition, according to an embodiment of the present disclosure, a signal may be applied to a speaker mounted on the exterior cover from the tablet PC in various ways, and the number of Codecs/amplifiers is variable without being limited.

According to an embodiment of the present disclosure, the exterior cover to which film speakers are applied, enables a low sound volume of a tablet PC to be complemented. In particular, due to the advantage of a thin and transparent film speaker, the film speaker can be mounted on a cover that also protects a display of a tablet PC.

In addition, according to an embodiment of the present disclosure, an exterior cover which has a film speaker applied thereto, may also be equipped with sound vibrators in the same manner in which low frequency band reproduction is insufficient with only with the film speaker. A sound vibrator may vibrate a surface on which the electronic device is placed such that the low frequency band may be complemented. Furthermore, applications in which a piezoelectric speaker or other sound components are mounted are also enabled.

Each of the above-described elements of the electronic device according to embodiments of the present disclosure may be comprised of one or more components, and the names of the elements may vary according to the type of electronic device. The electronic device according to embodiments of the present disclosure may include at least one of the above-described elements and some of the elements may be omitted or an additional element may be further included. In addition, some of the elements of the electronic device according to embodiments of the present disclosure may be combined into a single entity and may perform the same functions as those of the elements before being combined.

It will be appreciated that embodiments of the present disclosure according to the claims and description in the specification can be realized in the form of hardware, software or a combination of hardware and software.

Any such software may be stored in a computer readable storage medium. The computer readable storage medium stores one or more programs (software modules), the one or more programs comprising instructions, which when executed by one or more processors in an electronic device, cause the electronic device to perform a method of the present disclosure.

Any such software may be stored in the form of volatile or non-volatile storage such as an erasable or rewritable ROM, or in the form of memory such as, for example, RAM, memory chips, device or integrated circuits or on an optically or magnetically readable medium such as a CD, DVD, magnetic disk or magnetic tape and the like. It will be appreciated that the storage devices and storage media are embodiments of machine-readable storage that are suitable for storing a program or programs comprising instructions that when executed, implement embodiments of the present disclosure.

Accordingly, embodiments of the present disclosure provide a program comprising code for implementing apparatus or a method as claimed in any one of the claims of this specification and a machine-readable storage storing such a program. Such programs may be conveyed electronically via any medium such as a communication signal carried over a wired or wireless connection and embodiments suitably encompass the same.

Although certain embodiments have been described in the detailed description of the present disclosure, various changes and modifications may be made without departing from the spirit and scope of the present disclosure. Therefore, the scope of the present invention should not be defined as being limited to the embodiments, but should be defined by the appended claims and their equivalents.

What is claimed is:

1. An exterior cover for protecting a display of an electronic device, the exterior cover comprising:

a cover portion configured to foldably connect to the electronic device in a first end of the cover portion, the cover portion comprising:

segments comprising:

a first segment located at a first end of the cover portion, a second segment located at a second end of the cover portion opposite the first end, and a third segment located between the first segment and the second segment; and a folding axis allowing the segments to fold with respect to each other such that the folded segments support the electronic device in a cradle position when the electronic device is inclined at a first angle, wherein the first segment comprises a first speaker, the second segment comprises a second speaker, and the third segment comprises a third speaker, wherein the first speaker comprises a vibration plate and the first segment is in contact with a ground when the electronic device is in the cradle position, and wherein the vibration plate reproduces sound at a low frequency band, and the second speaker and the third speaker reproduce sound at higher frequency bands.

2. The exterior cover of claim 1, wherein the first second, and third speakers have an area that substantially covers an entire area of each of the segments.

3. The exterior cover of claim 1, wherein, when two or more of the first, second and third speakers are constructed with film speakers, the film speakers are made of a transparent material such that the film speakers also serve as a transparent window of the display.

4. The exterior cover of claim 3, wherein one or more of the film speakers are provided with a touch input unit.

5. The exterior cover of claim 1, wherein a structure of the folded segments comprises a triangular structure when the electronic device is in the cradle position.

6. The exterior cover of claim 5, wherein the third speaker comprises a vibration plate and the third segment is in contact with the ground when the electronic device is in a second cradle position in which the electronic device is inclined at a second angle lower than the first angle.

7. The exterior cover of claim 1, wherein each of the speakers is independently connected to an amplifier included in the electronic device.

8. The exterior cover of claim 7, wherein each of the amplifiers is independently connected to a codec included in the electronic device.

9. An electronic device comprising:

a display; and an exterior cover for protecting the display, the exterior cover comprising a cover portion configured to foldably connect to the electronic device in a first end of the cover portion, the cover portion comprising:

segments comprising a first segment located at a first end of the cover portion, a second segment located at a second end of the cover portion opposite the first end, and a third segment located between the first segment and the second segment; and a folding axis allowing the segments to fold with respect to each other such that the folded segments support the electronic device in a cradle position when the electronic device is inclined at a first angle, wherein the first segment comprises a first speaker, the second segment comprises a second speaker, and the third segment comprises a third speaker, wherein the first speaker comprises a vibration plate and the first segment is in contact with a ground when the electronic device is in the cradle position, and wherein the vibration plate reproduces sound at a low frequency band, and the second speaker and the third speaker reproduce sound at higher frequency bands.

10. The electronic device of claim 9, further comprising amplifiers independently connected to the speaker of each of the segments.

11. The electronic device of claim 10, further comprising codecs independently connected to each of the amplifiers.

12. The electronic device of claim 9, wherein the third speaker comprises a vibration plate and the third segment is in contact with the ground when the electronic device is in a second cradle position in which the electronic device is inclined at a second angle lower than the first angle.

* * * * *